United States Patent [19]

Werjefelt

[11] Patent Number: 4,627,431

[45] Date of Patent: Dec. 9, 1986

[54] PROTECTIVE HOOD WITH $CO_2$ ABSORBENT

[75] Inventor: Bertil Werjefelt, Kailua, Hi.

[73] Assignee: E. I. Du Pont de Nemours and Company, Wilmington, Del.

[21] Appl. No.: 710,670

[22] Filed: Mar. 12, 1985

[51] Int. Cl.[4] ..... A62B 7/00

[52] U.S. Cl. ..... 128/201.25; 128/201.28

[58] Field of Search ..... 128/201.25, 201.26, 128/201.29, 201.28; 2/424, 7, 8, 202, 205, 202.22

[56] References Cited

U.S. PATENT DOCUMENTS

| | | | |
|---|---|---|---|
| 3,562,813 | 2/1971 | Origer | 2/3 |
| 3,565,068 | 2/1971 | Bickford | 128/142 |
| 3,762,407 | 10/1973 | Shonerd | 128/142.3 |
| 3,895,625 | 7/1975 | DeLest | 128/201.25 |
| 3,942,524 | 3/1976 | Li et al. | 128/147 |
| 3,976,063 | 8/1976 | Henneman et al. | 128/201.25 |
| 4,154,234 | 5/1979 | Baker | 128/142 |
| 4,164,218 | 8/1979 | Martin | 128/142.7 |
| 4,231,118 | 11/1980 | Nakagawa | 2/7 |
| 4,233,970 | 11/1980 | Kranz | 128/201.28 |
| 4,407,723 | 10/1983 | MacGregor et al. | 128/201.25 |
| 4,428,907 | 1/1984 | Heijenga et al. | 128/202.22 |
| 4,440,164 | 4/1984 | Werjefelt | 128/205.25 |
| 4,523,588 | 6/1985 | Dolsky | 128/201.25 |

FOREIGN PATENT DOCUMENTS

| | | | |
|---|---|---|---|
| 857420 | 4/1940 | France | 128/201.25 |
| 67291 | 6/1978 | Japan | 128/201.25 |

*Primary Examiner*—Henry J. Recla

*Attorney, Agent, or Firm*—Donald W. Huntley

[57] ABSTRACT

A hood for providing breathable air having $CO_2$ absorption means within the hood.

13 Claims, 2 Drawing Figures

PROTECTIVE HOOD WITH $CO_2$ ABSORBENT

BACKGROUND OF THE INVENTION

A continuing concern for the aircraft industry is apparatus for the protection of passengers against either decompression in flight or toxic fumes resulting from on-board fires. Previously, oxygen masks and other apparatus have been provided for passenger use. However, previous apparatus do not satisfy the need for individual smoke protection of 30 minutes or more, and the size and weight of apparatus previously available have limited its use in aircraft. Typically, the ratios of equipment poundage to minutes of protection have been on the order of 1:0.5 to 1:3. In addition, much of the equipment previously available for decompression or toxic fume protection is complicated to use and might be of limited value to an aircraft passenger in an emergency situation. Accordingly, a continuing need exists for an uncomplicated, light-weight apparatus that will provide extended protection against toxic fumes in an aircraft environment. Similarly, a need exists for such an apparatus in a variety of other applications such as hotels and hospitals in which it may be necessary to escape from a smoke-filled environment with an apparatus that provides at least about 30 minutes of breathable air for the user.

SUMMARY OF THE INVENTION

The present invention provides a simple, light-weight, apparatus for toxic fume protection as well as decompression on board aircraft which supplies a user with at least about 30 minutes of breathable oxygen and also gives a ratio of equipment poundage to minutes of protection of 1:30, 1:40 or more.

Specifically, the instant invention provides a hood for providing the user of the hood with breathable air, the hood comprising:

(a) a generally tubular portion having open upper and lower ends and a continuous sidewall having inner and outer side surfaces, the generally tubular portion being comprised of a substantially gas-impermeable transparent film;

(b) a generally circular hood portion comprised of gas-impermeable film, the circular hood portion being connected to the upper end of the tubular portion;

(c) a substantially annular, resilient neck seal attached to the inner side portion of the lower end of the tubular portion, the neck seal having an opening for admitting at least the head of the user into the smoke hood to form a closure around the user; and (d) $CO_2$ absorption means disposed on the interior of the hood, the $CO_2$ absorption means being retained in semi-permeable membrane, the membrane having a porosity sufficient to retain the $CO_2$ absorption means out of contact with the user and allow $CO_2$ and water to pass through the membrane.

DETAILED DESCRIPTION OF THE INVENTION

Figure 1:
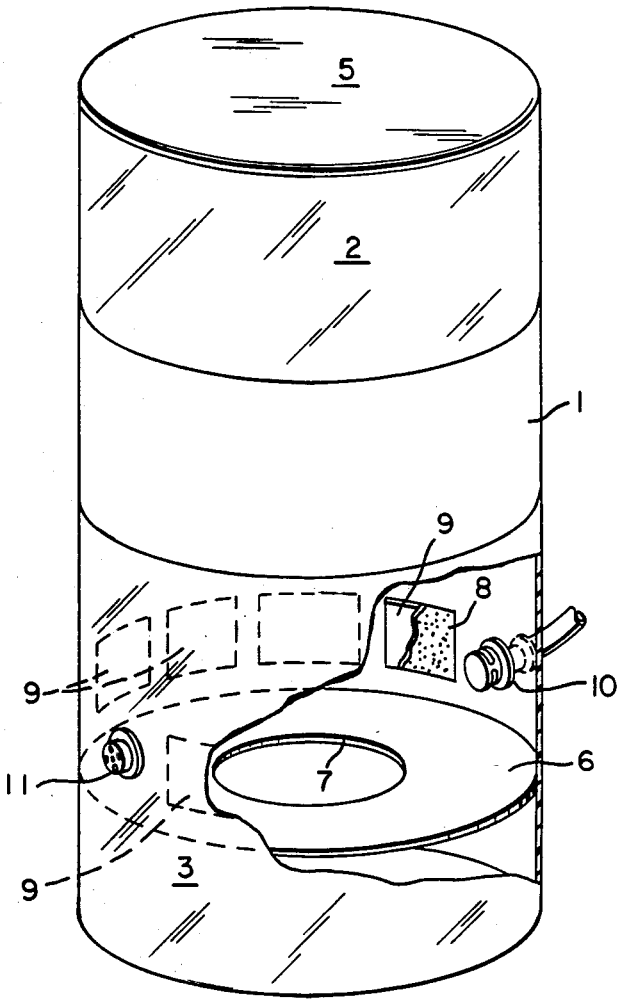
FIG. 1 is a cross-sectional view of a smoke hood of the present invention

In accordance with the present invention, a smoke hood or breathing device is provided that is prepared from gas-impermeable film. Such a device is illustrated in the drawing, in which generally tubular portion 1, having upper end 2 and lower end 3, has a continuous sidewall which forms the basic component of the smoke hood. The upper end of the tubular portion is bonded to circular hood portion 5. Substantially annular resilient neck seal 6 is attached to the inner side portion of the lower end of the tubular portion, the neck seal having an opening 7 for admitting at least the head of the user to form a closure around the user. $CO_2$ absorption means 8 is disposed on the interior of the hood. The $CO_2$ absorption means is encased in semi-permeable membrane 9 in the form of packets disposed around the interior sidewall of the tubular portion of the hood. The hood preferably further comprises inflow valve 10 and outflow valve 11.

The substantially gas-impermeable film which is used in the present invention can include a wide variety of polymeric films, such as polyethylene, polypropylene, polyethylene terephthalate, nylon, polyvinyl chloride, polyurethane, fluoropolymers and polyimides. The film should be, at least in part, transparent to permit visibility by the wearer. Heat resistant films are preferred for this application, of which polyimide films are particularly desirable. The exterior surface of the polymeric films used for the present devices can be metalized for further heat reflectivity, using metalizing techniques well known in the art.

In general, the size of the hood should provide an interior capacity, in excess of the user's head, of about from 2 to 30 liters. It has been found that this capacity provides the user with a sufficient volume of air which, in conjunction with the $CO_2$ absorption means of the present invention, provides a self-contained air supply that enables comfortable and safe breathing for up to about 60 minutes, depending, of course, not only on the volume of oxygen or air contained within the hood but the level of activity of the user.

In accordance with the present invention, $CO_2$ absorption means is disposed on the interior of the hood. A wide variety of carbon dioxide absorption means can be used in the present invention, including, for example, alkalai metal hydroxides and oxides, and sodium carbonate. Of these, the lithium and sodium salts are preferred, and lithium hydroxide in particulate form is particularly preferred. In addition, $CO_2$ absorbants in liquid or gel form can be used.

The $CO_2$ removal means is encased in semipermeable membrane. The membrane preferably has a number average pore size of about from 10 to 100 microns. This pore size permits contact of the gas and moisture within the hood and the $CO_2$ removal means, but prevents the smaller particles of $CO_2$ removal means from escaping into the breathing portion of the hood. The $CO_2$ absorption means is disposed on the interior of the hood, so as to bring the $CO_2$ removal means in contact with the gas within the hood.

The $CO_2$ absorption means permits maximum utilization of the available oxygen within the hood. Typically, a quantity of about from 50 to 500 grams, and preferably about from 75 to 150 grams, of $CO_2$ absorption means is used in a smoke hood of the present invention. About from 3 to 4 grams of lithium hydroxide are required for removal of carbon dioxide during each minute of closed circuit breathing in an environment of substantially pure oxygen.

The $CO_2$ absorbent can be disposed on the interior of the hood by any convenient means, including, for example, adhesive bonding to the sidewalls of the hood. However, regardless of the particular method of attaching the $CO_2$ absorption means to the interior walls of the smoke hood, the $CO_2$ absorption means should be covered by a semi-permeable membrane which simultaneously prevents direct inhalation of dust from the $CO_2$ absorption means while permitting contact with the gas inside the hood. Accordingly, the semi-permeable membrane used should have a number average pore size of about from 10 to 100 microns. Within these requirements, a wide variety of materials can be used, including, for example, various thermoplastic fabrics such as that commercially available from W.L Gore and Associates as "Goretex" expanded fluoropolymer fabric, HEPA Filters and spunbonded materials such as Tyvek® spunbounded fabric and Santora spunbonded fabric. Another particularly desirable semi-permeable membrane for use in the present invention is the product available from Foss Manufacturing Company as OAM-465 fabric. Still another commercially available product is that attainable from Garlock Corporation as Garlock expanded fluoropolymer film.

In an often preferred embodiment of the present invention, an inflow valve is provided for the hood which is adapted to be connected to a hose that communicates with an oxygen source to conduct breathable oxygen to the interior of the hood. The inflow valve can be positioned on any convenient portion of the hood, including the side, as shown in the figure, or the top of the hood. An outflow valve can similarly be provided. Thus, in an aircraft environment, the hood can be connected to the sources of fresh air or oxygen on board for a supply of breathable oxygen while seated. Upon disconnection from the source of breathable gas, the user can exit or move about the aircraft with a self-contained supply of breathable oxygen which, in conjunction with the $CO_2$ absorption means presently required, provides an extended supply of breathable oxygen for the user. The $CO_2$ absorption means permits utilization of available oxygen to a far greater extent than would be possible with the oxygen or air alone. The smoke hood can also contain an outflow valve to permit release of gas inside the hood when the interior pressure exceeds atmospheric pressure.

In a still further preferred embodiment of the present invention, a sensor is provided to detect buildup of nitrogen or corresponding oxygen deficiency within the smoke hood. With excessive buildup of carbon dioxide, a user will experience discomfort and remove the hood. In the absence of a $CO_2$ accumulation, the provision of a gas sensor within or in conjunction with the hood to warn the user of oxygen depletion is desirable. Such sensors are readily available, for example, from National Draeger Company or the Sierra Monitoring Corporation of California.

Figure 2:
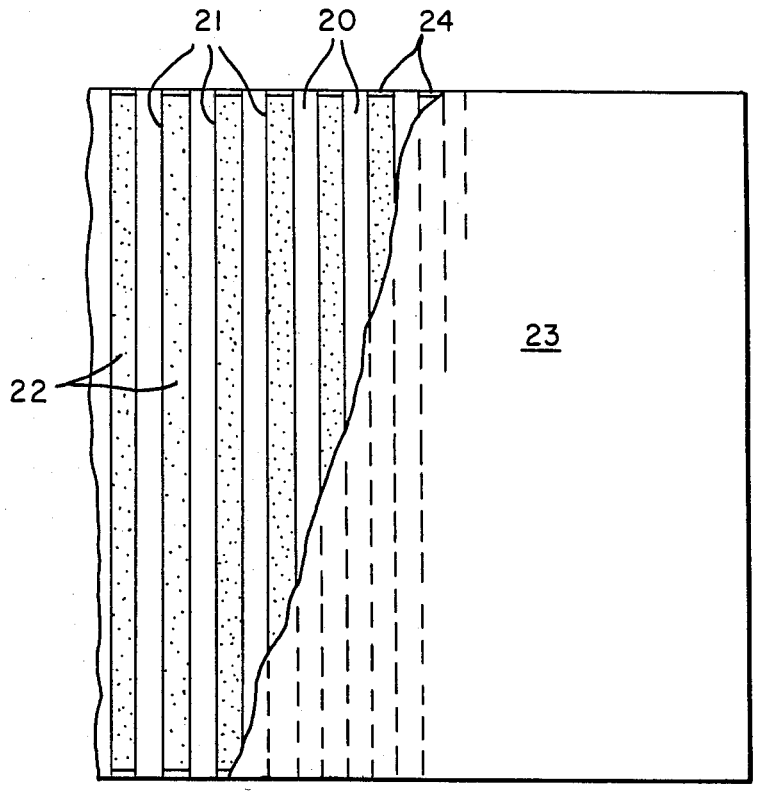
FIG. 2 illustrates a means for applying the $CO_2$ absorption means to the interior wall of the hood.

The tubular hood portion of the present smoke hoods can be prepared, for example, as described in detail in copending, coassigned application Ser. No. 494,845, hereby incorporated by reference. The $CO_2$ absorption means, as previously indicated, can be placed in packages of the semi-permeable membrane. It has been found particularly convenient to provide packets in which the thickness of $CO_2$ absorption means is about from 0.25 to 3 millimeters. Multiple packets of about from 100 to 1000 square centimeters have been found particularly convenient for applying the $CO_2$ absorption means on the interior of the hood; or the $CO_2$ absorption means can be provided as circumferential strips, or a circular packet for the top of the hood. In the alternative, the $CO_2$ absorption means can be distributed over a grooved film surface, as illustrated in FIG. 2. There, a first film 20 is provided with grooves 21. $CO_2$ absorption means 22 is disposed within the grooves of the first film. A second semi-permeable membrane 23 is then bonded over the top surface of the $CO_2$ absorption means, encasing the $CO_2$ absorption means between the two layers of semi-permeable membrane. At the ends of the grooves, the $CO_2$ absorption means is further encased by end closures 24. The dual layer of semipermeable membrane, with $CO_2$ absorption means encapsulated between the two layers, can then be bonded by any convenient means to the interior wall of the smoke hood. In a further alternative the side wall of the hood can also serve as one wall of the packet.

The hoods of the present invention provide the user with a simple, lightweight protective device that permits comfortable breathing, after disconnection from a source of oxygen or fresh air, for up to about 45 minutes with a 20 liter oxygen capacity in the hood. The lightweight construction and simplicity of operation makes the invention particularly useful for airline passengers, eliminating the weight and encumbrance of oxygen tanks or other complicated apparatus. The present hoods can be safely stored for extended periods of time without deterioration of their operating capabilities. However, it is preferred to store the hoods in a sealed container to insulate the devices from changes in environmental conditions.

In the alternative, the present smoke hood can be used in conjunction with existing oxygen masks currently available on commercial aircraft. A passenger can first don an existing oxygen mask and then don the smoke hood of the present invention. This will permit the user to more efficiently utilize existing oxygen for decompression protection in addition to providing a sealed environment for smoke protection. Upon disconnection, the user can continue to breathe for an extended period while moving about or exiting the aircraft.

The present hoods can be safely stored for extended periods without deterioration of their operation capabilities. However, it is preferred that the hoods be stored in a sealed container to insulate the devices from changes in environmental conditions.

The present apparatus makes more effective use of the oxygen supply systems currently in place on commercial air craft for decompression protection. The oxygen masks previously provided on air craft provide the user with a mixture of oxygen and ambient air, while the present devices provide the user with substantially pure oxygen for decompression as well as smoke protection. Moreover, the present invention does not require a pump or pressure source for operation of the $CO_2$ removal means once the hood has been filled.

The present invention is further illustrated in the following specific examples.

EXAMPLES 1–3

A smoke hood having a capacity of 26 liters was prepared from Kapton polyimide film. A single-sided strip of adhesive tape was placed around the upper perimeter of a cylindrical-shaped jig mold so that the adhesive side of the tape faced outwardly. A circularly cut polyimide film having a metalized outer reflective surface was placed over the upper end of the cylindrical jig mold. A first hoop assembly was lowered over the top of the jig mold, forcing the sides of the circularly cut film downward onto the mold to be adhered with the single-sided tape, after which the first hoop was removed. A strip of double-sided tape was then wrapped around the mold in the same position as that of the single-sided tape in order that the double-sided tape adhere to the portions of the circularly cut film covering the single-sided tape. The mold was then rolled longitudinally along the long side of a rectangular flat polyimide film. Once on the mold, the short sides of the rectangularly cut piece of film were adhesively attached such that the rectangular piece formed a cylinder. The hood assembly was then removed from the mold and the lower open end of the cylindrical-shaped film was rolled back so that it formed a skirt portion. A neck closure of silicone rubber was then attached to the inter wall at the lower end of the cylindrical piece of film above the rolled portion, after which the rolled portion was unrolled. A valve hole was formed in the hood and an inflow valve installed in the hole. 100, 200, and 400 grams of particulate lithium hydroxide in Examples 1, 2 and 3, respectively, were encased in semi-permeable membrane commercially available from Foss Manufacturing Company as OAM-465. The packets of encapsulated lithium hydroxide were placed adjacent to the interior wall surface of the smoke hood.

The smoke hood was donned by a user and charged with oxygen through an in-flow valve. The oxygen supply was then disconnected, and the user continued to breath for periods of 28 to 43 minutes, after which the hood was removed. The levels of $CO_2$, oxygen and nitrogen were monitored throughout the test, and no $CO_2$ or nitrogen were found throughout all but the last few minutes of the test.

I claim:

1. A hood for providing the user of the hood with breathable air, the hood comprising:

(a) a generally tubular portion having open upper and lower ends and a substantially non-perforated continuous sidewall having inner and outer side surfaces, the generally tubular portion being comprised of a substantially gas-impermeable film;

(b) a generally circular hood portion comprised of the gas-impermeable film, the circular hood portion being connected to the upper end of the tubular portion;

(c) a substantially annular, resilient neck seal attached to the inner side portion of the lower end of the tubular portion, the neck seal having an opening for permitting at least the head of the user into the hood to form a closure around the user; and (d) $CO_2$ absorption means disposed interiorly of the hood, a semi-permeable membrane retaining said $CO_2$ absorption means against a non-perforated portion of the inner surface of said tubular portion, the membrane having a porosity sufficient to retain the $CO_2$ absorption means out of contact with the user and allow $CO_2$ and moisture to pass through the membrane.

2. A hood of claim 1 wherein the $CO_2$ absorption means is in particulate form.

3. A hood of claim 2 wherein the $CO_2$ absorption means is selected from sodium hydroxide, sodium carbonate and alkaline earth metal hydroxides.

4. A hood of claim 3 comprising about from 50 to 500 grams of $CO_2$ absorption means.

5. A hood of claim 3 wherein the $CO_2$ absorption means consists essentially of lithium hydroxide.

6. A hood of claim 1 wherein the semi-permeable membrane has a number average pore size of about from 10 to 100 microns.

7. A hood of claim 1 further comprising an in-flow valve attached to the hood and passing through said tubular portion and adapted to be connected to a source of breathable oxygen.

8. A hood of claim 7 further comprising an outflow valve attached to the hood and passing through said tubular portion to permit release of gas inside the hood when the pressure inside the hood exceeds atmospheric pressure.

9. A hood of claim 1 wherein the semi-permeable membrane is a spunbonded fabric.

10. A hood of claim 1 wherein the semi-permeable membrane is a woven fabric.

11. A hood of claim 1 wherein the semi-permeable membrane is an expanded fluoropolymer laminated fabric.

12. A hood of claim 1 wherein the $CO_2$ absorption means is encased in packets of semi-permeable membrane bonded to the interior surface of the hood.

13. A hood of claim 1 having about from 75 to 150 grams of $CO_2$ absorption means and wherein the $CO_2$ absorption means consists essentially of lithium hydroxide.

* * * * *